US008193690B2

(12) United States Patent
Würsching et al.

(10) Patent No.: US 8,193,690 B2
(45) Date of Patent: Jun. 5, 2012

(54) LAMP CAP AND SOCKET ARRANGEMENT

(75) Inventors: István Würsching, Erzsébet tér (HU); József Fülöp, Nápoly u. (HU); Ferenc Papp, Ugró Gyula u. (HU); Károly Tálosi, Herkules u. (HU)

(73) Assignee: General Electric Company, Schenectady, NY (US)

( * ) Notice: Subject to any disclaimer, the term of this patent is extended or adjusted under 35 U.S.C. 154(b) by 239 days.

(21) Appl. No.: 12/427,357

(22) Filed: Apr. 21, 2009

(65) Prior Publication Data

US 2010/0264811 A1 Oct. 21, 2010

(51) Int. Cl.
*H01J 5/48* (2006.01)
*H01J 7/44* (2006.01)

(52) U.S. Cl. ..... 313/318.1; 313/318.09; 313/318.12; 439/646; 439/226

(58) Field of Classification Search ..... 313/318.01, 313/318.05, 318.06, 490, 318.12, 318.09; 439/646, 226, 236
See application file for complete search history.

(56) References Cited

U.S. PATENT DOCUMENTS 5,634,820 A * 6/1997 Vakil ..... 439/646
5,739,633 A 4/1998 Biro et al.
6,597,106 B2 7/2003 Tóth et al.
2002/0084743 A1* 7/2002 Toth et al. ..... 313/490
2002/0167263 A1* 11/2002 Nishio et al. ..... 313/490
2009/0045717 A1* 2/2009 Cavallaro et al. ..... 313/318.01

* cited by examiner

*Primary Examiner* — Karabi Guharay
(74) *Attorney, Agent, or Firm* — Fay Sharpe LLP

(57) ABSTRACT

There is provided a cap and socket arrangement for compact fluorescent lamps. The lamp comprises a discharge tube arrangement made of glass and having sealed ends being positioned at one end of the lamp. A continuous arc path is formed inside the discharge tube between two electrodes disposed at one end of the lamp. At least one of the sealed ends is also provided with an amalgam fill. The sealed ends of the discharge tube arrangement are received in the cap, and the cap comprises contact members and a protruding fitting member for being received in the socket. The socket has a hollow member for receiving the fitting member of the cap, and contact elements for receiving the contact members of the cap. The fitting member and the socket are provided with matching positioning elements for determining the position of the cap with respect to the socket and thereby determining the spatial position of the electrode with respect to the amalgam. The fitting member of the cap of the lamp may comprise an asymmetric groove and the socket may be provided with an asymmetric key element to be associated with the asymmetric groove of the cap.

20 Claims, 5 Drawing Sheets

LAMP CAP AND SOCKET ARRANGEMENT

FIELD OF THE INVENTION

This invention relates to a cap and socket arrangement for lamps.

BACKGROUND OF THE INVENTION

A wide variety of low-pressure discharge lamps are known in the art. These lamps use mercury vapor to generate UV radiation that is converted to visible light by a suitable fluorescent coating of the lamp envelope. In order to achieve best luminous performance of the lamp, the mercury vapor pressure has to be kept at a predetermined value with only little variation. In order to control the mercury vapor pressure, mercury is located in a mercury reservoir/container at a location away from the heated electrodes. Mercury vapor may be provided by liquid mercury or a mercury alloy also called amalgam. As the pressure of mercury vapor of such an amalgam at a given temperature is lower than the mercury vapor pressure of pure liquid mercury, amalgam proves as an ideal mercury source for compact fluorescent lamps (CFL-s), which are exposed to higher operation temperatures due to their smaller dimension. CFL-s typically have a mercury reservoir temperature of above 50° C. The amalgam is optimally positioned near a tip of the exhaust tube.

U.S. Pat. No. 6,597,106 discloses a compact fluorescent lamp with a housing structure including a plastic cap and a plastic socket. The sealed ends of the discharge tube arrangement are received in the cap having contact members, and a protruding fitting member for fitting in the socket. The socket has a hollow member for receiving the fitting member of the cap, and contact elements for receiving the contact members of the cap. The compact fluorescent lamp further comprises a tabulation, which contains amalgam material and communicates with the discharge tube.

Such lamps are widely used in private area and commercial places where energy saving and high luminous efficacy combined with a relatively long lifetime are important. It has however been observed that such lamps are more sensitive to ambient temperature than incandescent lamps. Low-pressure fluorescent lamps and particularly compact fluorescent lamps primarily are to be used in buildings and operated at room temperature in order to provide an optimum of luminous output. Even if used in buildings at regulated room temperature, fluorescent lamps may be exposed to abrupt changes of ambient temperature resulting in heat shocks that have a negative impact on the luminous output. Temperatures substantially below or above the room temperature may result in a substantial drop of luminous intensity of such lamps.

Therefore, there is a need for a fluorescent lamp configuration with a cap and socket arrangement, which exhibits improved luminance, e.g. which is less sensitive to changes of the ambient temperature and therefore no substantial difference in the luminous output of the lamp may be perceived when the lamp is operated under changing ambient temperatures due to positioning of the lamp. More specifically, there is a need to provide a lamp configuration, which does not exhibit a significant decrease in the luminous efficacy when operated in any position, also including a horizontal, base-up or a base-down position. Therefore a lamp configuration is required, which has an improved control of amalgam reservoir temperature for optimum performance of the lamp.

SUMMARY OF THE INVENTION

In an embodiment of the present invention, there is provided a cap and socket arrangement for compact fluorescent lamps. The lamp comprises a discharge tube arrangement made of glass and having sealed ends being positioned at one end of the lamp. The discharge tube arrangement forms a continuous arc path and has electrodes disposed at each end of the arc path. At least one of the sealed ends is also provided with an amalgam fill. The sealed ends of the discharge tube arrangement are received in the cap, and the cap comprises contact members and a protruding fitting member for being received in the socket. The socket has a hollow member for receiving the fitting member of the cap, and contact elements for receiving the contact members of the cap. The fitting member of the cap of the lamp comprises an asymmetric groove and the socket is provided with an asymmetric key element to be associated with the asymmetric groove of the cap for determining the position of the cap with respect to the socket and thereby determining the spatial position of the electrode with respect to the amalgam.

Surprisingly, it has been found that the spatial position of the fluorescent lamps comprising heated electrodes at one end of the lamp and an amalgam fill at the same end of the lamp significantly influences the thermal behavior of the amalgam reservoir containing the amalgam fill. As both the electrodes and the amalgam reservoir with the amalgam fill, are located at the same end of the lamp, more specifically at the base side, the heat developing in and radiated from the electrodes also heat the neighboring region of the lamp, especially the region above the electrodes. This is due to thermal convection. This situation is depicted in the diagram of FIG. 4, showing the luminous output of a CFL as a function of the ambient temperature. In one case, the heated cathodes were situated under the amalgam fill (curve I—cathode down position) and in the other case the heated cathodes were above the amalgam fill (curve II—cathode up position). It can be clearly seen that a cathode down lamp's light output increases at a lower temperature and reaches the maximum output earlier (at a lower ambient temperature) which falls back at higher ambient temperatures. This behavior of the lamp can be explained with the fact that the cathodes heat the amalgam reservoir due to the thermal convection. When the lamp is mounted in a cathode-up position, light output increases at a higher ambient temperature and the luminous output rises slower, e.g. it reaches the maximum output later. Therefore in applications with an ambient temperature range between T1 and T3 or preferably between T2 and T3, a CFL with a cathode-down will provide better performance, however when the ambient temperature is in a range above T3, a cathode-up position of the CFL will provide higher luminous output. During these measurements, the heat generated by the cathodes (thermal convection) caused the flow of air only.

In case of externally forced airflow, the demonstrated phenomena become more expressed.

In different applications, due to different thermal environment, a CFL may have different positions for optimum performance. For example, if the lamps are mounted in closed fixture providing still air around the lamp, the lamps have typically a horizontal orientation with the amalgam fill above or under the electrodes of the lamp. In such a case for example, it would be advantageous to operate the CFL-s in a horizontal orientation with the amalgam fill under the electrodes of the lamp or in other words, in a cathode-up orientation. On the other hand, if the horizontally mounted CFL-s are located in a room where cold air may stream into the room through the window, and the cold air-flow reaches the lamps (range between T2 and T3), it would be advantageous to operate the CFL-s in a horizontal orientation with the amalgam fill above the electrodes of the lamp or in other words, in a cathode-down orientation.

With a lamp configuration that uses the cap and socket arrangement according to the invention, the relative position of the cap with respect to the socket, and thereby the relative position of the electrode with respect to the amalgam is determined in order to operate the lamp at a substantially controlled amalgam reservoir temperature.

BRIEF DESCRIPTION OF THE DRAWINGS

The invention will now be described with reference to the enclosed drawings, where.

DETAILED DESCRIPTION OF THE INVENTION

Figure 1:
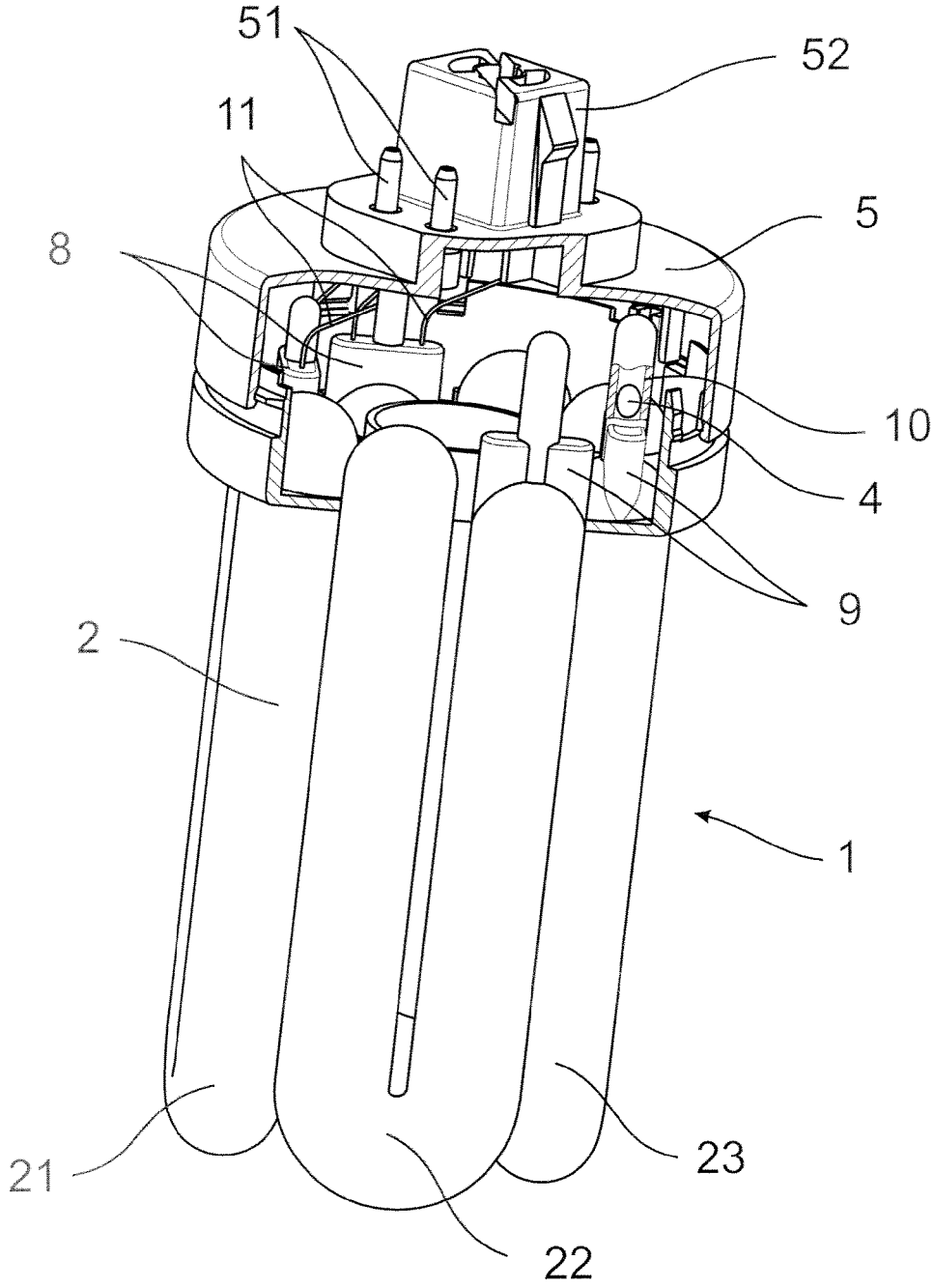
FIG. 1 is a perspective view of a CFL with electrodes and an amalgam reservoir at the base side of the lamp.

Referring first to FIG. 1, there is shown a compact fluorescent lamp 1. The lamp 1 has a discharge tube arrangement 2, preferably made of glass, and has sealed ends 8, 9 being positioned at one end of the lamp. The discharge tube arrangement 2 encloses a discharge volume, which is filled with a discharge gas composed of an inert gas or a mixture of inert gases and mercury vapor in order to generate and maintain discharge inside the discharge volume. A luminescent layer covers the inner surface of the tubes of the discharge tube arrangement, which typically is a blend of different phosphor components that converts UV radiation into visible light. A continuous arc path can be formed inside the tube arrangement between the electrodes that are disposed at the base end of the lamp in proximity of the sealed ends 8. The electrodes are fixed to current-lead wires 11 led through the sealed ends 8 of the discharge tubes. In this example, the lamp 1 has three U-shaped discharge tube portions 21, 22 and 23, which are interconnected by bridges, through which the individual discharge tube portions may communicate with each other. Mercury is present as a mercury alloy or amalgam 4 in a reservoir at one of the sealed ends 9 in order to provide and regulate the required mercury vapor pressure inside the discharge volume having an optimum pressure which is typically in the range of 6 to 20 millitorrs. In the embodiment shown in FIG. 1, an exhaust tube 10 forms the amalgam reservoir and has a sealed end at the base side of a discharge tube. However, in the shown lamp only one amalgam fill is employed, it may be apparent to those skilled in the art that more than one amalgam fill may be used for generating the required mercury vapor inside the discharge tube arrangement. In the embodiment shown in FIG. 1, the amalgam fill is applied to the sealed end 9 of the discharge tube arrangement that has no electrodes, but it is also possible to apply the amalgam fill to a sealed portion of the discharge tube arrangement with an electrode. Using an amalgam at a sealed portion of the discharge tube arrangement with an electrode improves the cold start properties of the CFL as suggested in U.S. Pat. No. 5,739,633.

Figure 2:
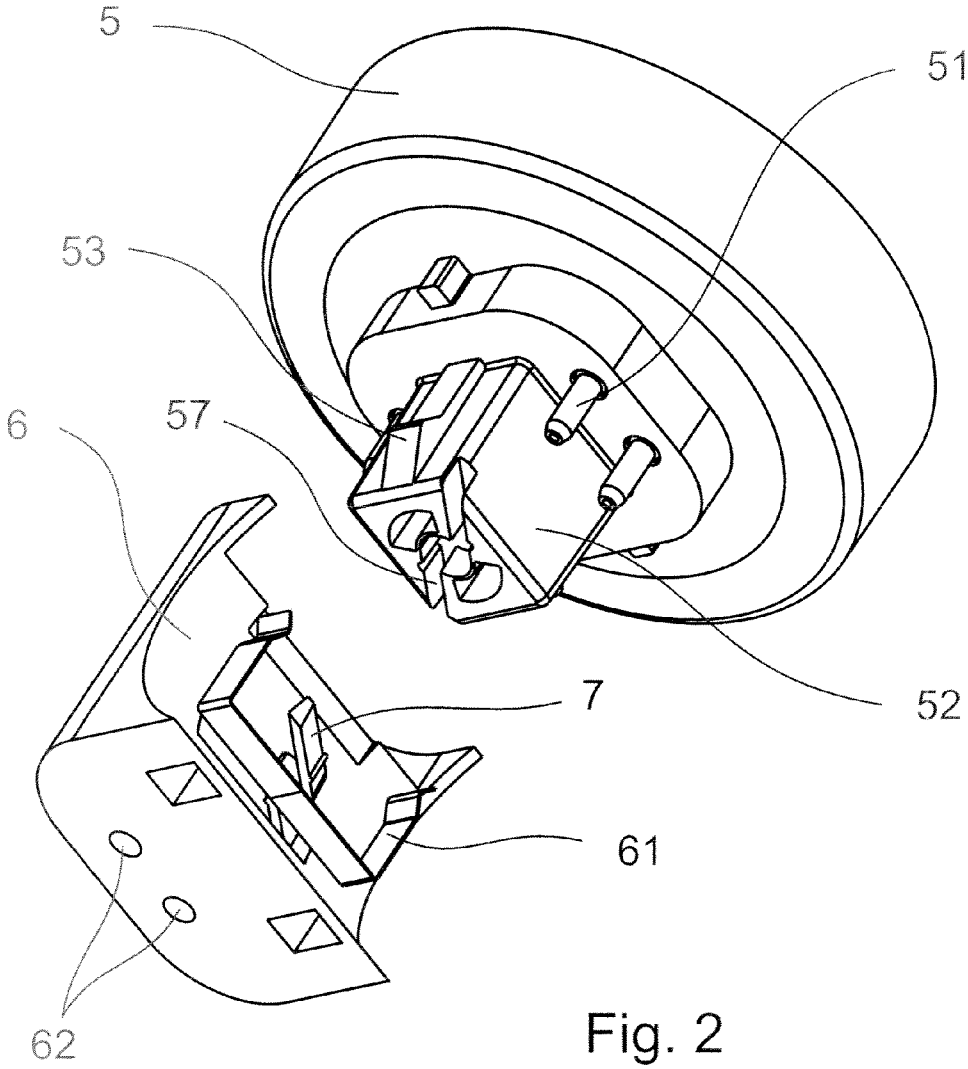
FIG. 2 is a perspective view of the cap and socket arrangement of an exemplary embodiment of the invention.

The sealed ends of the discharge tube arrangement are received in a cap 5. As shown in FIG. 2, the cap comprises contact members 51 and a fitting member 52 for being received in a socket 6 with a matching fitting member or receiving member. In the embodiment shown in FIGS. 1, 2, 7 and 8, the cap 5 is of type G24q, but it may be any other standardized or non-standardized plug-in type or bayonet type cap. The fitting member 52 of the cap in the shown embodiment is a protruding fitting member and the matching fitting member or receiving member of the socket is a hollow fitting or receiving member for receiving the cap and for providing form engagement between the cap and the socket. The contact members 51 of the cap are formed by four contact pins for being connected to an associated power supply for energizing the electrodes. The cap is further provided with fixing elements 53 for enabling a firm fixing inside the socket. The socket has a hollow member for receiving the fitting member 52 of the cap, and contact elements 62 for receiving the contact members 51 of the cap 5. The socket further comprises resilient fixing elements 61 for holding the capped lamp firmly inside the socket 6 and to enable removal or replacement of the lamp upon application of a pulling force of a predetermined magnitude. The socket may further be provided with symmetric key elements 63 in order to inhibit the insertion of a lamp of an incompatible type or wattage with respect to a specific application.

In order to provide for a predetermined relative position of the cap 5 with respect to the socket 6, the fitting member of the cap and the fitting or receiving member of the socket are provided with matching positioning elements. In the embodiments shown in FIGS. 2 to 8, the positioning element of the cap is an asymmetric groove 57 and the positioning element of the socket is a matching asymmetric key element 7 for being received in the asymmetric groove. Such an arrangement will allow the cap 5 to be received inside the socket 6 only in one receiving position. Therefore it will also determine the spatial position of the electrodes with respect to the at least one amalgam fill of the lamp.

The key element 7 shown in FIGS. 2, 3 and 5 to 8 is formed as an insertable key element but it may also be formed as an integral part of the socket in order to accomplish the required effect. Irrespective of the fact that the key element is formed as an integral or a separate part, it may be made of a material same as or different from the socket. In case of an integral key element and selecting the same material as the material of the socket, the key element may be produced in one manufacturing process together with the socket. On the other hand, if the key element is formed as a separate part, it can be used for subsequent completion of a socket when it is intended to be used in connection with a lamp having a cap portion with a matching positioning element, e.g. a matching asymmetric groove.

Figure 5:
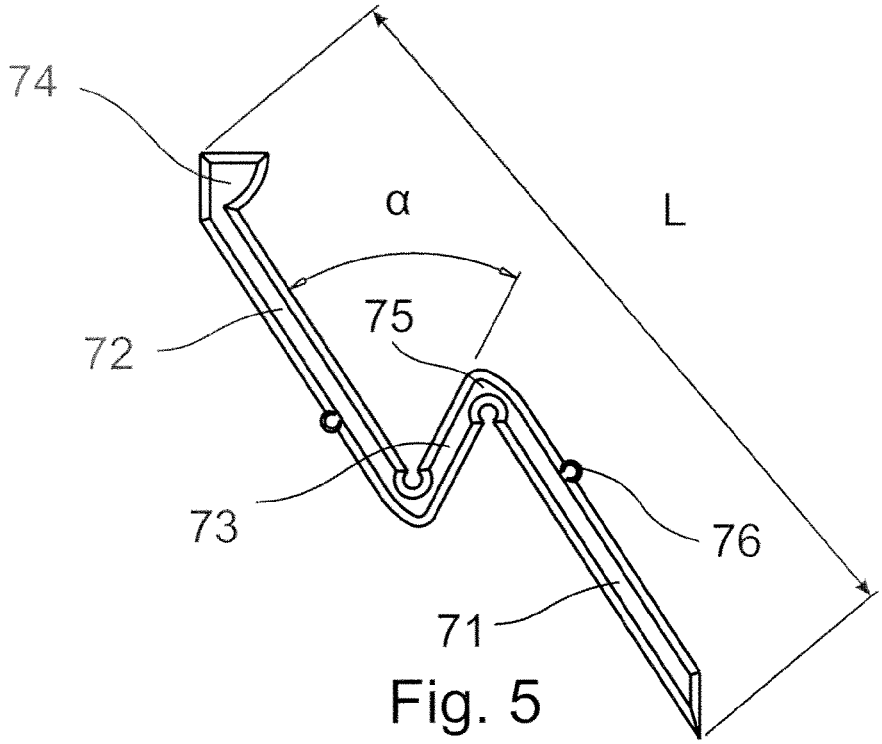
FIG. 5 is a top view of the insert in a released state.
Figure 6:
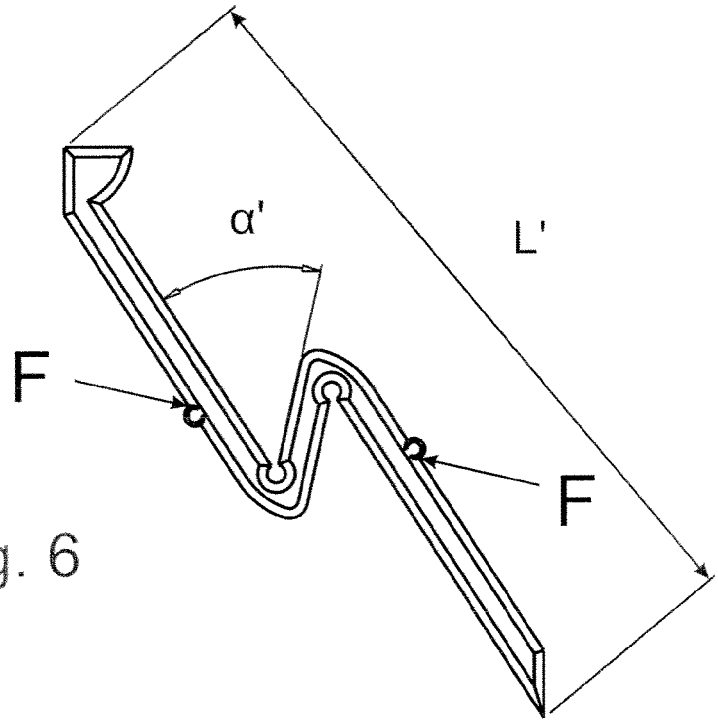
FIG. 6 is a top view of the insert in a compressed state.

The key element will be described in detail with reference to FIGS. 3, 5 and 6. The key element 7 has two substantially straight end sections 71, 72 and one substantially straight intermediate section 73 being in an angled position relative to the end sections. The substantially straight end sections 71, 72 enclose an acute angle with the substantially straight intermediate section 73. In order to be used as an asymmetric positioning element, the two substantially straight end sections 71, 72 have differently shaped end portions. More particularly, one of the end sections 72 has a widening end portion 74. The asymmetric character of the key element is established in the shown embodiment by the widening end portions but as it will be apparent to a person skilled in the art, that any other difference in the shape, width or length may be suitable in order to provide the asymmetric key element. The asymmetric groove in the fitting member 52 has a matching form so as to receive the asymmetric key element in only one receiving position in order to determine the relative position of the cap with respect to the socket and consequently the spatial position of the electrodes with respect to the amalgam fill.

Figure 7:
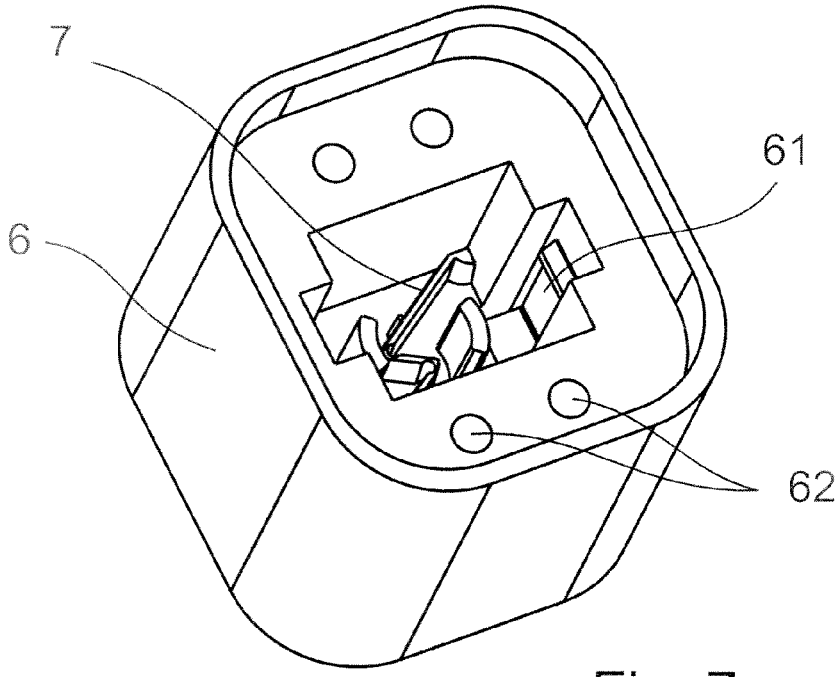
FIG. 7 is a perspective view of the socket part of the cap and socket arrangement with the insert.
Figure 8:
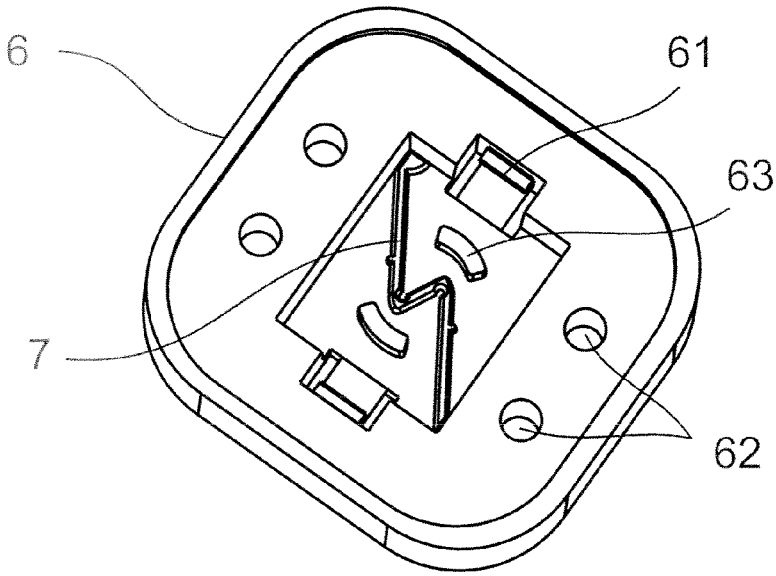
FIG. 8 is another perspective view of the socket part of the cap and socket arrangement with the insert.

In order to enable an easy handling of an insertable asymmetric key element, that is inserting into and removing from the hollow receiving member of the socket, as best seen in FIGS. 7 and 8, the key element should be made of a resilient material or of a material that has resilient portions. A shown in FIGS. 3, 5 and 6, the substantially straight end sections 71, 72 and a substantially straight intermediate section 73 are connected to each other by a connecting portion 75. The connecting portions between the end sections and the intermediate section are configured to have a higher resilience than the substantially straight middle and end sections. To this end, they have and an arcuate shape with a tapered wall thickness with respect to the wall thickness of the substantially straight middle and end sections. Moreover, the connecting portions 75 are configured to have a substantially circular recess at the inner side so as to enable a compression of the substantially straight end sections 71, 72 towards each other. When using the asymmetric key element in connection with a G24q type socket, due to manufacturing tolerances a diagonal dimension of 20.79 to 21 mm has to be considered as a general dimension for determining the dimension of the key element. As shown in FIG. 5, the asymmetric key element has a diagonal length dimension L in a released state which is preferably slightly greater than the largest diagonal dimension of the socket. Therefore the asymmetric key element may have a diagonal length dimension of L=21.12 mm. In the released state of the asymmetric key element, the substantially straight end sections 71, 72 enclose an acute angle $\alpha$ with the substantially straight intermediate section 73 which may be about 60 degrees. Before inserting or removing the asymmetric key element, its diagonal length dimension has to be decreased to a value below the smallest diagonal dimension of the socket. Therefore before insertion or removal, the asymmetric key element may have a compressed diagonal length dimension of L'=20.42 mm. In this compressed state of the asymmetric key element, the substantially straight end sections 71, 72 enclose an acute angle $\alpha'$ with the substantially straight intermediate section 73 which may be about 45 degrees.

In order to provide for a better accessibility of the asymmetric key element, the substantially straight end sections 71, 72 may have protrusions 76 or noses on their outer side wall, in proximity of the connecting portions 75 according to an alternative embodiment. They allow the key element to be gripped easily. The distance of the protrusions from the connecting portions 75 may be substantially equal to the length of the substantially straight intermediate section 73. With such a configuration, it will be easy to have access to and to apply a compression force F to the substantially straight end sections 71, 72 by using a tool or simply two fingers.

Figure 3:
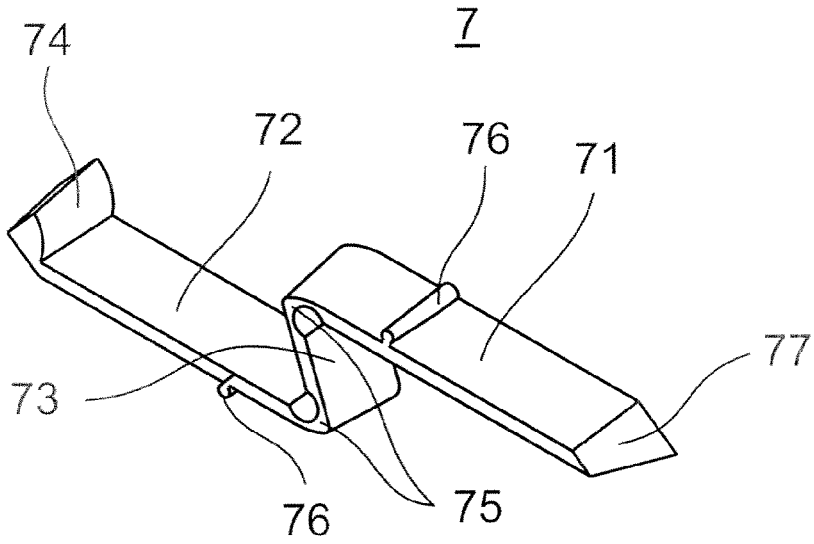
FIG. 3 is a perspective view of an insert used in the cap and socket arrangement.
Figure 4:
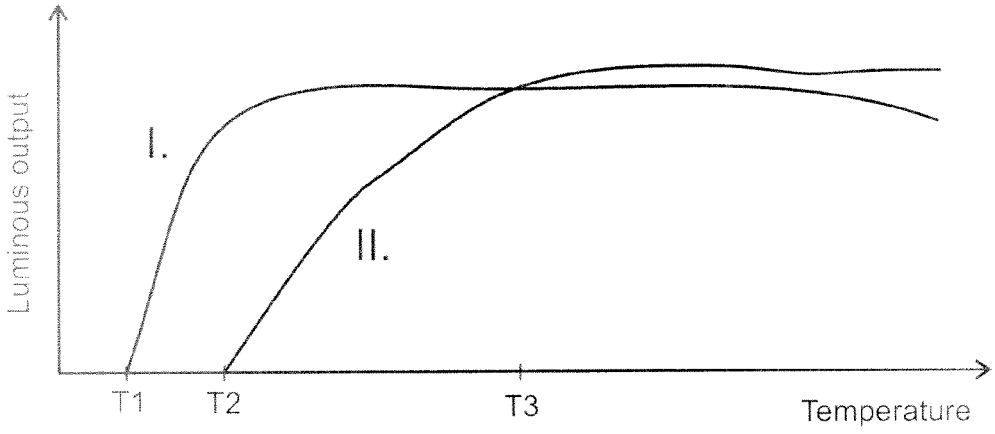
FIG. 4 is a diagram showing the luminous output of a CFL as a function of the ambient temperature.

In a further alternative embodiment, the key element may have a wedge-like cross sectional shape with a wider side towards a base portion of the socket and a narrow side towards the cap, as best seen in FIG. 3. The wedge-like shape with a substantially trapezoid cross section 77 of the asymmetric key element 7 makes it even more easy to plug the capped lamp into the socket without any collision of the edges of the asymmetric key element 7 in the socket and the asymmetric groove 57 in the fitting member of the cap.

Although specific embodiments have been illustrated and described herein for purposes of description of the preferred embodiment, it will be appreciated by those of ordinary skill in the art that a wide variety of alternate or equivalent implementations may be substituted for the specific embodiments shown and described without departing from the scope of the present invention.

The invention claimed is:

1. A cap and socket arrangement for compact fluorescent lamps, the lamp comprising a discharge tube arrangement made of glass and having sealed ends being positioned at one end of the lamp;

the discharge tube arrangement forming a continuous arc path and being provided with electrodes disposed at each end of the arc path;

at least one of the sealed ends also being provided with an amalgam fill;

the sealed ends of the discharge tube arrangement being received in the cap, the cap comprising contact members, and a protruding fitting member for being received in the socket, the socket comprising a hollow member for receiving the fitting member of the cap, and contact elements for receiving the contact members of the cap;

the fitting member of the cap of the lamp having an asymmetric groove; and the socket being provided with an asymmetric key element to be associated with the asymmetric groove of the cap for determining the position of the cap with respect to the socket.

2. The cap and socket arrangement of claim 1, in which the cap is further provided with fixing elements and the socket comprises fixing elements for securing the capped lamp.

3. The cap and socket arrangement of claim 1, in which the key element is formed as an integral part of the socket.

4. The cap and socket arrangement of claim 1, in which the key element is formed as an insertable key element.

5. The cap and socket arrangement of claim 4, in which the key element is made of the same material as the socket.

6. The cap and socket arrangement of claim 4, in which the key element is made of a different material than the socket.

7. The cap and socket arrangement of claim 4, in which the key element is formed of a resilient material.

8. The cap and socket arrangement of claim 7, in which the key element has two substantially straight end sections and a substantially straight intermediate section being in an angled position relative to the end sections.

9. The cap and socket arrangement of claim 8, in which the two substantially straight end sections have differently shaped end portions.

10. The cap and socket arrangement of claim 9, in which one of the end portions has a widening.

11. The cap and socket arrangement of claim 8, in which the end sections of the key element are substantially parallel to each other and the end sections enclose an acute angle with the intermediate section.

12. The cap and socket arrangement of claim 8, in which the two substantially straight end sections and a substantially straight intermediate section are connected to each other by a connecting portion.

13. The cap and socket arrangement of claim 12, in which the connecting portions between the end sections and the intermediate section have an arcuate shape.

14. The cap and socket arrangement of claim 12, in which the resilience of the connecting portions is higher than the resilience of the intermediate section and the end sections.

15. The cap and socket arrangement of claim 14, in which the connecting portions have a tapered wall thickness relative to the wall thickness of the intermediate section and the end sections.

16. The cap and socket arrangement of claim 8, in which the end sections are further provided with a nose on an outside surface portion.

17. The cap and socket arrangement of claim 4, in which the key element has a wedge-like transversal cross sectional shape with a wider side towards a base portion of the socket and a narrow side towards the cap.

18. A cap and socket arrangement for compact fluorescent lamps, the lamp comprising:

a discharge tube arrangement made of glass and having sealed ends at one end of the lamp;

the discharge tube arrangement forming a continuous arc path and being provided with electrodes disposed at each end of the arc path;

at least one of the sealed ends also being provided with an amalgam fill;

the sealed ends of the discharge tube arrangement being received in the cap, the cap comprising contact members and a fitting member for being received in the socket;

the socket having a receiving member for receiving the fitting member of the cap, contact elements for receiving the contact members of the cap; and the fitting member of the cap and the receiving member of the socket being provided with matching positioning elements for determining the position of the cap with respect to the socket and thereby determining the spatial position of the electrode with respect to the amalgam, wherein the fitting member of the cap of the lamp comprises an asymmetric groove and the socket is provided with an asymmetric key element to be associated with the asymmetric groove of the cap for determining the spatial position of the electrodes to the amalgam fill.

19. A lamp with a base cap and an associated socket arrangement, the lamp comprising at least one heated electrode and at least one amalgam fill, the electrodes and the amalgam fills being positioned relative to each other in the lamp;

the cap comprising a protruding fitting member for being received in the socket;

the socket comprising a hollow member for receiving the fitting member of the cap;

the fitting member of the cap having a groove; and the socket being provided with a key element to be associated with the groove for determining the position of the cap relative to the socket and thereby determining the spatial position of the electrodes with respect to the amalgam fills, wherein the fitting member of the cap of the lamp comprises an asymmetric groove and the socket is provided with an asymmetric key element to be associated with the asymmetric groove of the cap for determining the spatial position of the electrodes to the at least one amalgam fill.

20. A lamp with a base cap and an associated socket arrangement, the lamp comprising at least one heated electrode and at least one amalgam fill, the electrodes and the amalgam fills being positioned relative to each other in the lamp;

the cap comprising a protruding fitting member for being received in the socket;

the socket comprising a hollow member for receiving the fitting member of the cap;

the fitting member of the cap and the receiving member of the socket being provided with matching positioning elements for determining the position of the cap relative to the socket and thereby determining the spatial position of the electrodes with respect to the amalgam fills, wherein the matching positioning elements include an asymmetric groove in the fitting member of the cap and the socket is provided with an asymmetric key element to be associated with the asymmetric groove of the cap for determining the spatial position of the electrodes to the at least one amalgam fill.

* * * * *